US009341454B1

(12) United States Patent
Strandberg et al.

(10) Patent No.: US 9,341,454 B1
(45) Date of Patent: May 17, 2016

(54) DIRECTED FRAGMENTATION WEAPON

(71) Applicant: OY FORCIT AB, Hanko (FI)

(72) Inventors: Rolf Strandberg, Hanko (FI); Eugen Kidron, Hangonkylä (FI)

(73) Assignee: OY FORCIT AB, Hanko (FI)

( * ) Notice: Subject to any disclaimer, the term of this patent is extended or adjusted under 35 U.S.C. 154(b) by 0 days.

(21) Appl. No.: 14/564,765

(22) Filed: Dec. 9, 2014

(30) Foreign Application Priority Data

Dec. 9, 2014 (FI) ..... 20146076

(51) Int. Cl.
*F42B 12/32* (2006.01)
*F42B 23/24* (2006.01)

(52) U.S. Cl.
CPC ..... *F42B 12/32* (2013.01); *F42B 23/24* (2013.01)

(58) Field of Classification Search
CPC ..... F42B 12/32; F42B 23/24; F42B 12/22; F42B 12/24; F42B 23/10; F42C 15/42
USPC ..... 102/475, 476
See application file for complete search history.

(56) References Cited

U.S. PATENT DOCUMENTS 2,972,949 A * 2/1961 MacLeod ..... 102/401
3,646,888 A * 3/1972 Posson et al. ..... 102/496
3,750,587 A * 8/1973 Walde ..... 102/496
3,970,005 A * 7/1976 Rothman ..... 102/492
5,003,885 A * 4/1991 Rudolf et al. ..... 102/494
5,313,890 A * 5/1994 Cuadros ..... 102/496
H1390 H * 1/1995 Campagnuolo et al. ..... 434/11
6,298,788 B1 * 10/2001 Woods et al. ..... 102/502
8,950,332 B1 * 2/2015 Iden et al. ..... 102/498
2007/0151550 A1 * 7/2007 Fitting et al. ..... 124/73
2009/0165664 A1 * 7/2009 Jones et al. ..... 102/355

* cited by examiner

*Primary Examiner* — Joshua Freeman
(74) *Attorney, Agent, or Firm* — Oliff PLC

(57) ABSTRACT

Directed fragmentation weapon including a housing having front, back, top edge, bottom edge and side edge walls defining a closed chamber therein. The front wall is formed as a pellet matrix construction including a plurality of compartments formed as recesses on the surface facing the inside of the chamber. The compartments are substantially similar in shape and size to each other and a plurality of pellets of fixed diameter within the matrix. Each compartment contains one pellet therein. Explosive material is placed into the chamber, which is sufficient to propel the pellets from the matrix, and a detonator arrangement for exploding the material. Depths of a part or all of the compartments measured perpendicularly to the front wall and from the inner surface of the front wall are defined by equation $$h=C\times A \quad \text{(I)}$$

Figure 1:
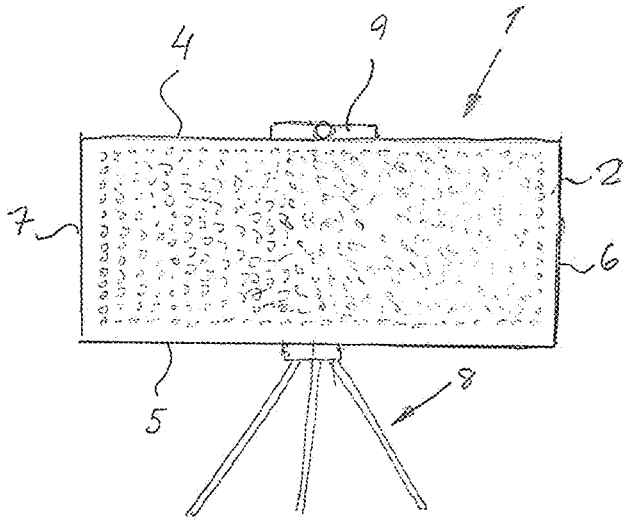

wherein equation coefficient C is 0.1-3, and A is the pellet diameter.

6 Claims, 3 Drawing Sheets

DIRECTED FRAGMENTATION WEAPON

The invention relates to directed fragmentation weapon comprising a housing having a front wall, a back wall, a top edge wall, a bottom edge wall and side edge walls defining a closed chamber therein, the front wall being formed as a pellet matrix construction including a plurality of compartments formed as recesses on the surface of the front wall facing to the inside of the chamber, the compartments being substantially similar in shape and size to each other and a plurality of pellets having a diameter fixed within the pellet matrix, each compartment containing one pellet therein, explosive material placed into the chamber, the explosive material being sufficient to propel the plurality of pellets from the pellet matrix, and a detonator arrangement for exploding the explosive material.

The development of direction fragmentation weapons dates back to the days of the Second World War. The development of direction fragmentation weapons started from the fact that when a sheet of explosive detonates in contact with a heavy backing surface, for example a metal plate, the resulting blast is primarily directed away from the surface in a single direction. This basic feature was used to discover an efficient side-attack anti-tank weapon. The development was however incomplete at the end of the war. Together with the work relating to the anti-tank weapon discussed above designers also spent time researching a trench mine that used a directional fragmentation effect. This development was however also incomplete at the end of the war.

The development continued strongly during the next large war conflict, the Korean War as a result of the massed Chinese attacks. At least Canada and the United States began to develop a project to counter these massive Chinese attacks. For example Canada fielded a weapon called the Phoenix landmine. Said landmine used the directed detonation effects discovered during the Second World War discussed above to project a spray of small steel cubes towards the enemy. The weapon developed was however too large to be a practical infantry weapon and was relatively ineffective, with a maximum effective range of about 20-30 meters.

As a result of the learning in the Korean War development was still continued in the early fifties by the efforts of Norman Macleod. The result of this development was a weapon called the T-48 which was later developed to the final M18A1. Norman MacLeod applied for a patent for the mine on Jan. 18, 1956 and a patent was granted on Feb. 28, 1961 under number U.S. Pat. No. 2,972,949.

U.S. Army accepted the weapon developed into service as the M18 Claymore and it was used in small numbers in Vietnam around 1961. It was not until the improved M18A1 was developed that the Claymore became a significant weapon. M18A1 was first used in Vietnam in 1966.

Later on the development work was continued all over the world and a number of licensed and unlicensed versions have been widely used for years by the military forces in various countries all over the world.

Area Access and Area Denial capabilities, especially in the area of Non-Line of Sight (NLOS) have been of increased interest after countries have moved away from antipersonnel mines (APN). The removal of anti-personnel mines has created a significant reduction on capabilities for force protection and counter mobility capabilities of countries. Protection of high value targets and operational vignettes, such as base camps, entry control points, borders and section of routes still require capabilities to maintain secure and controlled modern asymmetrical and non-linear protection operations. Man-in-the-loop (MITL) Directed Fragmentation weapon system is one of the key solutions on maintaining the above discussed capability and still being in full compliance with the Ottawa Agreement/Treaty.

Directed fragmentation weapons were originally developed as lethal military weapons. During the later years however needs have been risen also for example in police operations or in other operations carried out by civil authorities, i.e. needs to have an effective non-lethal weapon for use in controlling crowds of people for example in riots and mobs. In rioting and mass mob actions normally police units alone or sometimes police units in co-operation with military units may be confronted with sudden situations in which effective amount of non-lethal force must be used in order to maintain control of the situation.

Relating to the matters discussed above directed fragmentation weapons have been developed from their original lethal military versions to non-lethal crowd control versions using pellets made of soft material, for example rubber, plastic or other soft compositions. As examples of appropriate plastic materials high density polyethylene, polyvinyl chloride and other similar polymer compositions can be mentioned.

As a practical example of said non-lethal directed fragmentation crowd control weapons a device described in U.S. Pat. No. 6,298,788 can be mentioned.

One of the most important features in a directed fragmentation weapon is its ability to deliver fragments in similar pre-determined formation in each detonation. This feature guarantees a perfect distribution on target area and therefore collateral damage is reduced and also safety of the operators of the weapon and friendly forces is increased. The devices known from the prior art documents are not ideal in this respect.

An object of the invention is to eliminate the disadvantages of the prior art. This is obtained by the present invention. The present invention is characterized in that depths of a part or all of the compartments measured perpendicularly to the front wall and from the inner surface of the front wall are defined by equation (I) $h=C\times A$ in which equation coefficient C is 0.1-3, and A is the diameter of the pellet (FIGS. 4-7).

An advantage of the invention is in that the ability to deliver fragments in similar pre-determined and controlled formation in each detonation is excellent. It must be noted further that the advantage discussed above can be obtained with all materials of the fragments used. The fragments can be chosen according to the existing need, i.e. the fragments can be of any size and any material. Another advantage of the invention is its simplicity making the invention inexpensive and easy to materialize by using automated process. The invention is also very flexible, i.e. the invention can be modified quite freely in size etc.

Figure 2:
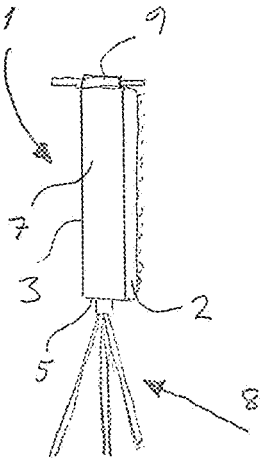
Figure 3:
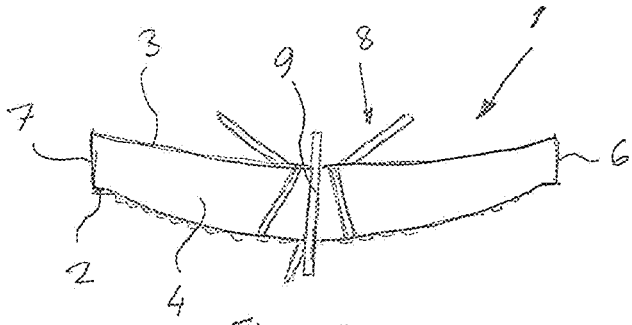

In the following the invention will be described in closer detail by means of exemplary embodiments described in the accompanying drawings, in which FIG. 1 shows a front schematic view of a basic structure of one embodiment of the present invention, FIG. 2 shows a side view of the embodiment shown in FIG. 1, FIG. 3 shows a top side view of the embodiment shown in FIGS. 1 and 2, FIGS. 4-7 show constructional details of different embodiments of the basic structure shown in FIGS. 1-3, FIGS. 8-9 show two schematic examples of the fragment formation after detonation obtainable with the invention.

FIGS. 1-3 show schematically the basic structure of a directed fragmentation weapon. Weapon comprises a housing 1 having a front wall 2 and a back wall 3. Housing 1 comprises further a top edge wall 4, bottom edge wall 5 side edge walls 6 and 7.

The housing can be manufactured of any material for example plastic material.

The charge shown in FIGS. 1-3 comprises further a stand structure 8 for example a tripod or scissors legs stand structure and a sight structure 9 for aiming the weapon. The tripod stand structure and the sight structure shown in FIGS. 1-3 are shown on as examples of typical structures. Both the stand structure and the sight structure can be varied quite freely, i.e. all stand structure and sight structures known as such can be used. Stand structure 8 can be for example a structure by which the weapon can be fastened for example to a tree and sight structure 9 can be for example a simple open sight, a tube sight, an optical sight etc.

The front wall 2 of the housing is formed as a pellet matrix construction. The above mentioned pellet matrix construction is a preformed part and includes a plurality of compartments 11 formed as recesses on the surface of the front wall 2 facing to the inside of the chamber. The compartments 11 are substantially similar in shape and size to each other. There is further a plurality of pellets 12 having a diameter A fixed within the pellet matrix. Each compartment 11 contains one pellet 12 therein.

Explosive material 10, i.e. booster charge and/or main charge, is placed into a closed chamber formed by the walls of the housing 1. The explosive material is placed behind the front wall 2. The amount of explosive material 10 is sufficient to propel the plurality of pellets 12 from the pellet matrix. There is also a detonator arrangement for exploding the explosive material. The above mentioned detonator arrangement can be of any type known in the field. The detonator arrangement discussed above is quite familiar to a person skilled in the art. The detonator arrangement is not shown in the Figures. Explosive material 10, compartments 11 and pellets 12 are clearly shown in FIGS. 4-7.

According to the basic idea of the invention depths of at least a part of the compartments measured perpendicularly to the front wall and from the inner surface of the front wall are defined by equation (I) $h=C\times A$ in which equation coefficient C is 0.1-3, and A is the diameter of the pellet.

Figure 4:
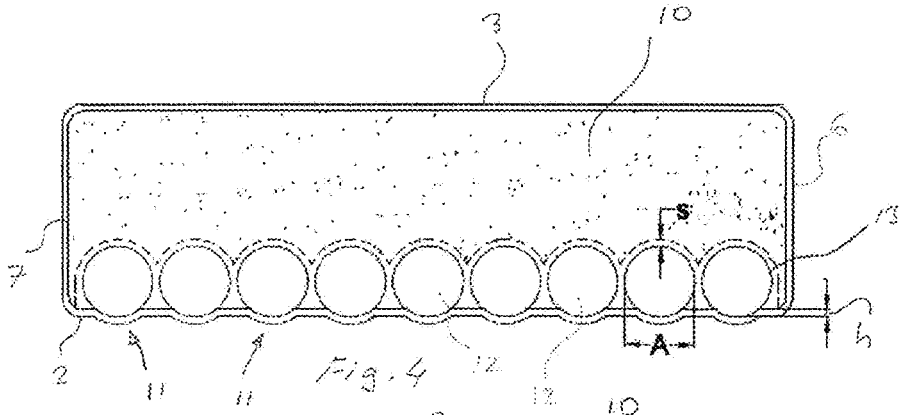
Figure 5:
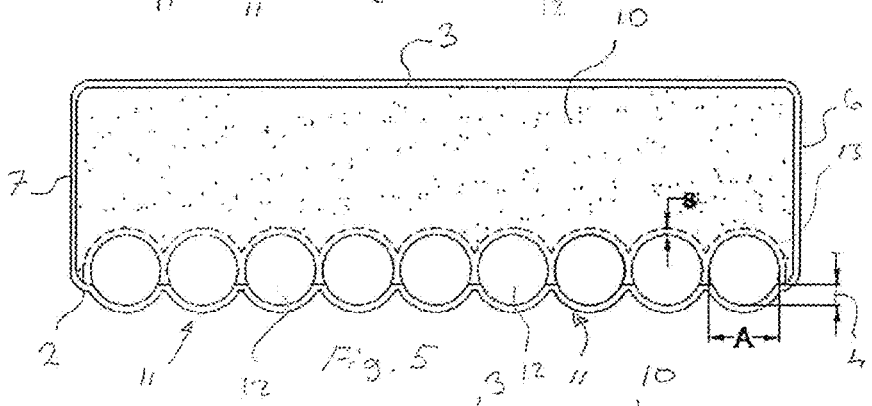
Figure 6:
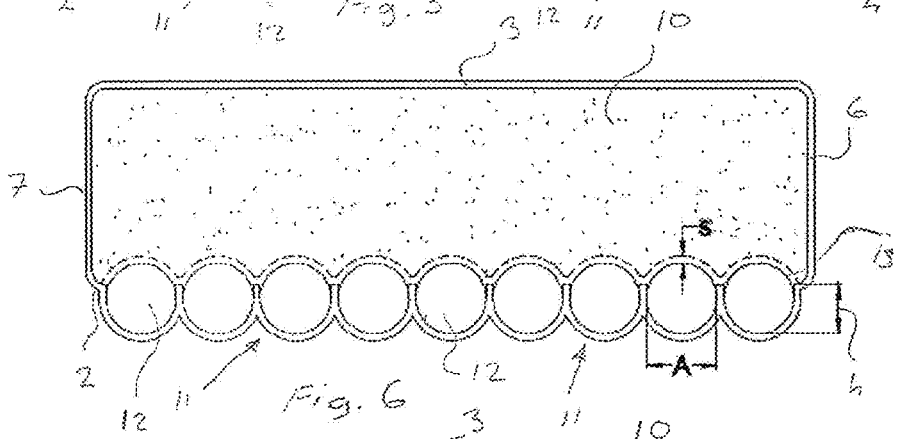
Figure 7:
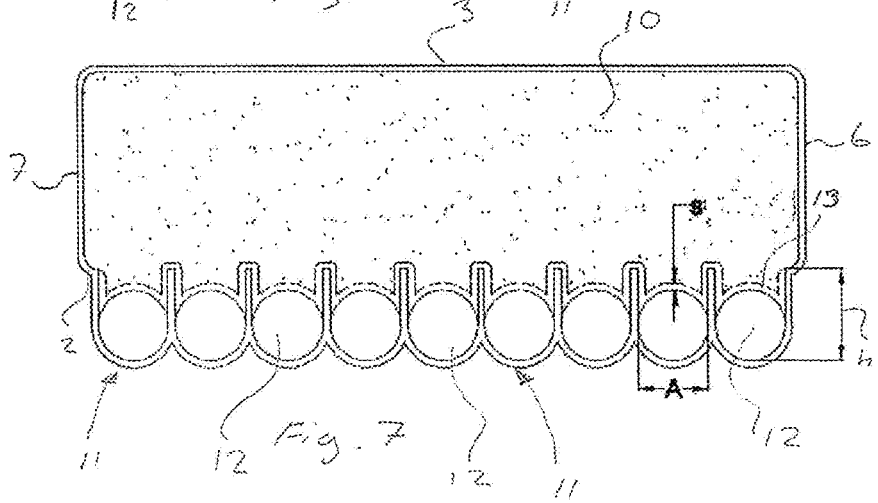

FIGS. 4-7 show four examples in which the depth h of the compartments 11 are different so that FIG. 4 shows the value for h which is the smallest one in these examples and FIG. 7 shows value for h which is the greatest one in these examples. The depth values of h shown in FIGS. 5 and 6 lie between the depth values of h shown in FIGS. 4 and 7.

As shown in FIGS. 4-7 and discussed above the preformed front wall 2 is provided with compartments 11 or sockets defined by factors A which represents the diameter of the pellet 12, and a coefficient C which varies between 0.1 to 3, i.e. the depth h may vary in the way discussed above. Coefficient 0.1 represents the smallest depth value and coefficient 3 represents the greatest depth value.

The invention enables the exact positioning the pellets in exact and predetermined position in the front wall 11 whereby a desired form and range for the fragment fan is obtained. In other words the form and range of the fragment fan can always be obtained with the invention by using a predetermined compartment depth h in the front wall. The above discussed exact result is always the same in each detonation when the same compartment depth is used. This is because by using the invention it is possible to locate every pellet into an exactly correct, predetermined and desired position. Different ranges and forms for fragment fan i.e. fragment distribution after detonation can be obtained by making different front walls, i.e. front walls with different compartment depths.

It has been found that the best result is obtained when the depths of all compartments of the front wall are defined by using the equation (I).

Figure 8:
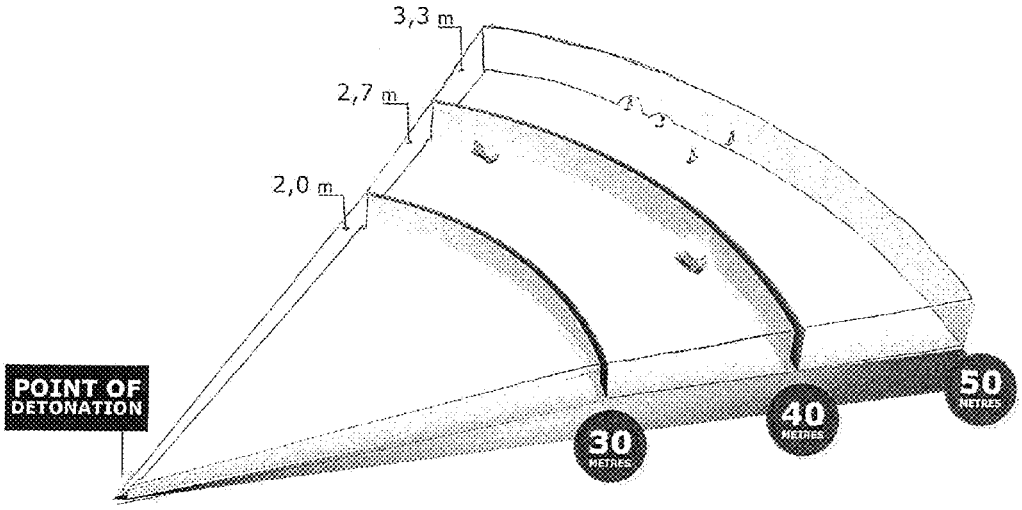
Figure 9:
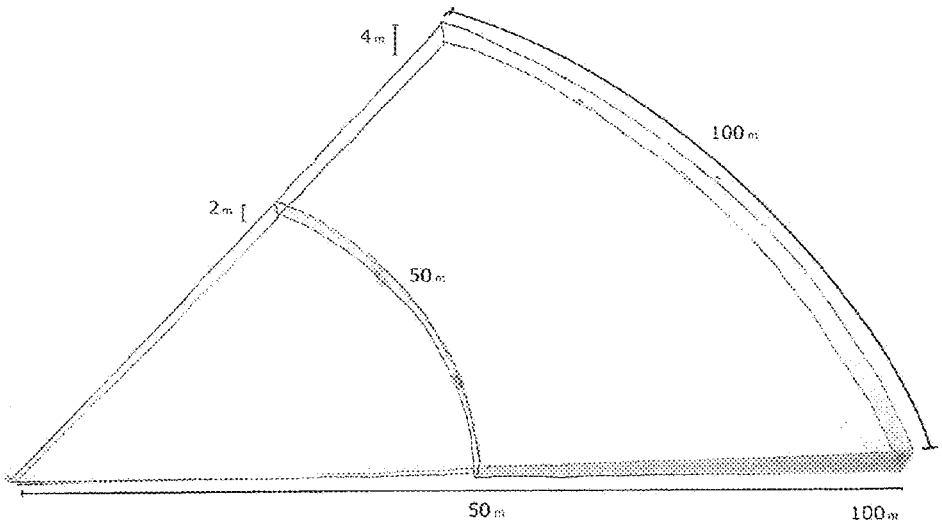

FIGS. 8 and 9 show two examples of the fragment fan or formation after detonation. The fragments may develop any degree fragment fan from 10 to 180 degrees in vertical and/or horizontal directions in front of the charge itself.

Pellets 11 can be kept in the compartments 11 by using an adhesive 13 which can be placed on front side or on back side of the pellet. The adhesive can also be placed on both sides of the pellet 12. Explosive material 10 is placed behind the pellets 12 as discussed above. The explosive material can also support the pellets 11 to hold them in place for example in situations in which any vibrations or shocks are acting to the casing. It is however quite possible, in order to obtain certain special effects to make a clear distance or space between the explosive material 10 and the pellets 12 with an inert material. The above mentioned distance or space is shown with a reference s in FIGS. 4-7. The value of s may vary between 0 and the value of A, i.e. the diameter of the pellet.

The front wall 2 is usually rather thin. Thickness of the front wall may vary from less than 1 mm to about 5 mm so that said thickness does not inhibit too much the movement of the fragments or decrease kinetic energy or speed of the fragments after the explosive material has been detonated.

The invention has been described above by means of the exemplary embodiments shown in the figures. The invention is however not restricted in any way to the examples of the figures but the invention may be freely modified within the scope of the claims. Thus the shape and dimensions of the casing and its details on pellets may be freely modified according to the existing needs, and the materials can also be chosen freely in order to obtain the results needed.

The invention claimed is:

1. Directed fragmentation weapon comprising:

a housing having a front wall, a back wall, a top edge wall, a bottom edge wall and side edge walls defining a closed chamber therein, the front wall being formed as a pellet matrix construction including a plurality of compartments formed as recesses on the surface of the front wall facing to an inside of the chamber, the recesses being open to the inside of the chamber, the compartments being substantially similar in shape and size to each other and a plurality of pellets having a diameter fixed within the pellet matrix, each compartment containing one pellet therein, explosive material placed into the chamber, the explosive material being sufficient to propel the plurality of pellets from the pellet matrix, and a detonator arrangement for exploding the explosive material, depths of a part or all of the compartments measured perpendicularly to the front wall and from the inner surface of the front wall being defined by equation $$h=C\times A \quad \text{(I)}$$

in which equation coefficient C is 0.1-3, and A is the diameter of the pellet.

2. Directed fragmentation weapon according to claim 1, wherein the depths of all compartments of the front wall are defined by using the equation (I).

3. Directed fragmentation weapon according to claim 2, wherein the pellets are arranged to be kept in the compartments by using an adhesive.

4. Directed fragmentation weapon according to claim 3, wherein the adhesive is placed on front or back side of the pellets or on front and back sides of the pellets.

5. Directed fragmentation weapon according to claim 1, wherein the pellets are arranged to be kept in the compartments by using an adhesive.

6. Directed fragmentation weapon according to claim 5, wherein the adhesive is placed on front or back side of the pellets or on front and back sides of the pellets.

* * * * *